United States Patent [19]

Stone, Jr.

[11] Patent Number: 4,757,923

[45] Date of Patent: Jul. 19, 1988

[54] POURING DEVICE FOR REDUCING OXIDATION AND EVAPORATION OF COFFEE

[75] Inventor: Wayne B. Stone, Jr., Bethesda, Md.

[73] Assignee: Wood Manufacturing Co., Inc., Flippin, Ark.

[21] Appl. No.: 476,444

[22] Filed: Mar. 17, 1983

Related U.S. Application Data

[63] Continuation of Ser. No. 216,834, Dec. 15, 1980, abandoned.

[51] Int. Cl.[4] ..... A47G 19/14

[52] U.S. Cl. ..... 222/481; 222/475.1; 222/564; 222/570

[58] Field of Search ..... 222/464, 465, 465 A, 222/475, 478, 547, 564, 566, 567, 570, 568, 569; 220/855 P

[56] References Cited

U.S. PATENT DOCUMENTS

| | | | |
|---|---|---|---|
| 465,934 | 8/1891 | Bartley et al. | 222/464 X |
| 598,447 | 2/1898 | Spencer | 99/319 |
| 675,277 | 5/1901 | Henry | 222/475 X |
| 1,434,740 | 11/1922 | Gibson | 222/465 |
| 2,842,167 | 7/1955 | Tupper | 222/570 X |
| 4,363,262 | 12/1982 | Pinckley et al. | 222/95 X |

FOREIGN PATENT DOCUMENTS

| | | | |
|---|---|---|---|
| 35071 | 10/1905 | Switzerland | 222/464 |
| 349316 | 2/1931 | United Kingdom | 222/566 |

*Primary Examiner*—Joseph J. Rolla
*Assistant Examiner*—Frederick R. Handren
*Attorney, Agent, or Firm*—Banner, Birch, McKie & Beckett

[57] ABSTRACT

The method of and apparatus for reducing oxidation and evaporation of coffee in a wide-mouth decanter, such as those primarily intended for use with automatic coffee makers, by way of providing a cover for the wide mouth thereof, and in which there is provided a pour spout extending within the coffee decanter, the ingress orifice of the pour spout opening within the lower fourth of the coffee decanter, and the vent opening thereof being of a cumulative area such that the vapor pressure of heated coffee in the decanter exceeds atmospheric pressure to substantially create a vapor seal thereacross.

28 Claims, 3 Drawing Sheets

POURING DEVICE FOR REDUCING OXIDATION AND EVAPORATION OF COFFEE

This application is a continuation, of application Ser. No. 216,834, filed Dec. 15, 1980, now abandoned.

BACKGROUND OF THE INVENTION

The deterioration of coffee, i.e. the loss of a "fresh" or palatable flavor and aroma, is primarily caused by oxidation and evaporation. In a conventional 8–12 cup coffee receptacle, deterioration is generally so complete within one or two hours, depending on the rate of consumption, as to render the remaining coffee undrinkable.

The role of oxidation, alone, in deteriorating coffee flavor is obvious to anyone who drinks coffee from a sealed container. When the container is first opened, whether after one or several hours, the coffee tastes perfectly fresh. If the container is resealed with a small amount of coffee remaining therein, such as a half a cup, it rapidly deteriorates as evidenced by the poor taste when it is consumed, say, one hour later. There was obviously no significant evaporation from the sealed container but fresh air was admitted at the time the first cup was poured.

The deteriorating role of evaporation is even more obvious as the coffee solution is concentrated by evaporation.

The concept of extending the "pot life" of coffee, i.e. that time period during which it retains the flavor and aroma of freshly brewed coffee, by substantially eliminating its exposure to atmoshpere while yet retaining the ability to pour coffee in conventional fashion was introduced by applicant's prior U.S. Pat. No. 3,974,758. In a pour type coffee receptacle, the patented concept involves sealing the main body of contained coffee with respect to atmosphere. The top of the receptacle is sealed by a movable follower, such as a bellows or bag, and that coffee contained within the lower end of a small diameter pour spout opening into the coffee receptacle adjacent the bottom thereof serves as a liquid seal between atmosphere and the main body of the receptacle contained coffee.

The result is that the only oxidation that can occur takes place at the upper coffee level in the pour spout. By keeping the cross section of the pour spout sufficiently small, that quantity of coffee that is oxidized and subsequently finds its way through the liquid seal to the main reservoir of contained coffee is negligible over the first 4–8 hours depending upon the cross section of the pour spout. Similarly, the only loss to atmosphere that can occur by way of evaporation is at the small uppwer coffee level in the pour spout since a state of equilibrium inherently exists across a gas/vaporizable liquid interface in a sealed container.

Stated differently, the patented concept involves pouring from the bottom of the pot while keeping the top of the pot sealed with a movable follower maintaining atmospheric pressure on the coffee so that it can be poured without creating a vacuum lock.

Previously, the pour spout for "pouring from the bottom" of the pot has been formed externally of the pot as illustrated in applicant's prior patent. This, of course, requires special tooling since conventional coffee pots are not made with small cross section pour spouts opening into the lower portion of the pot.

The purposes of the present invention are; to eliminate the need for a movable follower while yet retaining the advantages of the patented concept, to adapt the same for use with conventionally manufactured coffee receptacles such as those glass decanters used with automatic drip coffee makers and, implicit in the latter, to contain the necessary structure within the height and circumferential profiles of the coffee receptacle with which it is to be used to insure a dimensional match with the particular coffee maker for which the receptacle is sized.

SUMMARY OF THE INVENTION

The concept of substantially sealing the main body of contained coffee with respect to atmosphere by a liquid seal comprising the liquid column in a small diameter pour spout extending to the bottom of the receptacle so that one, in effect, pours from the bottom of the pot is retained. However, the pour spout extends upwardly from the bottom of the pot within the surrounding confines of the peripheral pot wall to emerge through a top assembly closing the open upper end of the receptacle.

If the open top of the receptacle were totally sealed in the absence of a movable follower member to keep atmospheric pressure on the coffee, coffee could not be dispensed through the pour spout because of the vacuum lock that would occur. The need for a movable follower may be eliminated and coffee readily dispensed while yet retaining substantially all the advantages of a totally sealed receptacle by providing vent means of such small dimension that the vapor pressure of a quantity of contained coffee within the receptacle exceeds atmospheric pressure. The result is a vapor seal, across the vent means, that precludes the ingress of air at all times except when coffee is actually being dispensed through the pour spout. The volume of entry air that occurs during pouring is, of course, negligible as compared with that volume which enters a conventional open pot over a period of from one to several hours. Stated differently, the oxidation effected by the minimal air indrawn during pouring produces no significant deteriorating effect over a period of several hours.

A concomitant, and significant, consequence of the restricted vent means is greatly reduced evaporation as compared with a conventional receptacle from which the vapor may freely escape.

Thus where vapor may freely escape, equilibrium across the gas/liquid interface is never attained and evaporation may proceed to completion. Conversely, in a closed system, partial pressures of the coffee vapor will increase until a state of equilibrium exists at which time for every molecule escaping across the liquid/gas interface in gaseous form another is returning from the gaseous to the liquid form at which point no further liquid volume loss to evaporation occurs. The latter is what occurs in the patented process where the space above the receptacle contained coffee is totally sealed.

An analogous result can be achieved by the restricted vent means herein disclosed and claimed which, in effect, imposes a back pressure on the contained gaseous phase so that equilibrium is approached with the result that percentage return from the gaseous to liquid phase approaches that of escape from liquid to gaseous. The result, over a period of up to 6-8 hours, depending on the rate of depletion by dispensing, is negligible coffee volume loss to evaporation. In actual tests conducted with a six cup volume in a twelve cup receptacle with the coffee maintained at 175° F. and a single 1/16"

diameter vent hole; loss to evaporation was less than one-third cup over a five hour period as contrasted with a two and one-half cup loss to evaporation from a conventional receptacle. It will be obvious that the smaller the vent means the closer the approach to equilibrium and the lesser volume loss to evaporation.

In summary, concerning the vent means which for the present explanation will be assumed as a single pin hole in an otherwise sealed top of a coffee receptacle through which a pour spout extends to near the bottom of the receptacle; the vent means is necessary to permit pouring of the coffee, in the absence of any movable parts, without developing a vapor lock. Regarding its role in reducing oxidation, the vent means must be of sufficiently small cumulative area to produce a back, or superatmospheric, pressure within the receptacle to prevent ingress of air by a vapor seal across the vent means when the receptacle is in the upright, or non pouring, position. The role of the restricted vent means in reducing volume loss through evaporation is that of causing the partial pressure across the gas/liquid interface to approach equilibrium.

Since the overall purpose of the invention is to insure that the entire contents of a coffee receptacle may be consumed without having to discard the last few cups because they have deteriorated to an unpalatable state; the importance of having a small diameter pour spout extend to substantially the bottom of the receptacle and remain submerged at all times as the coffee level is depleted may be appreciated. Thus by the time the coffee level has been substantially depleted, as for example to the two or three cup line, both oxidation and evaporation will, if permitted, play a far greater deteriorating role than when a full decanter of coffee is initially made. First, the smaller coffee volume will be at a higher temperature than the original filled decanter (assuming a standard, automatic drip coffee maker burner to be used) and as with most other chemical reactions, oxidation is accelerated by increased temperatures as is the rate of evaporation. Secondly, deterioration due to oxidation proceeds more rapidly because of the proportionally greater surface area exposure in a small volume while even an equal rate of evaporation produces a far greater proportional concentration in a small, as compared with a large, volume of liquid. If the lower end of the pour spout does not remain submerged as the coffee level is depleted the liquid seal is broken, air reaches the remaining coffee to oxidize the same and the approach to equilibrium across the liquid/gas interface is destroyed allowing evaporation to proceed toward completion. This is why many conventional coffee pots of the electric or stove top percolator type which have outside pour spouts are not suitable for use with the present invention. In all cases they have at least a portion of the pour spout opening into the pot at a level well above the bottom of the pot and as soon as this upper level of the pour spout opening into the pot is reached by the declining coffee level the remainder of the coffee is quickly deteriorated by oxidation and evaporation.

Accordingly, the entirety of the lower open end of the pour spout must be positioned so that it remains completely submerged at all times, with the liquid seal intact, until substantially all the coffee is dispensed else the primary advantage of retaining the palatability of the remaining coffee is lost. There is no advantage in maintaining the liquid seal intact when there is only one cup of coffee remaining in the pot, rather the most desirable arrangement is where the liquid seal is retained intact until after the next to last cup of coffee is poured for the obvious reason that when the last cup is to be poured it is immaterial whether it be dispensed through the pour spout or the top assembly, including the pour spout, be removed and the last cup dispensed over the side of the receptacle in the usual fashion. In actual practice, with various 8–12 cup coffee receptacles, it is generally sufficient to insure that the liquid seal remains intact until after the third from last cup is dispensed since the seal will then remain until the next to last cup is dispensed leaving only one cup subject to the deteriorating effects of oxidation and evaporation. In actual practice it is found that this last cup is usually consumed before it is substantially deteriorated. The foregoing translates into a necessary positionment of the lower open end of the pour spout adjacent that side of the receptacle from which the coffee will be poured and at such a height above the bottom of the receptacle that the entire lower open end of the pour spout remains completely submerged at remaining coffee levels falling generally within the range of 1/6 to ¼ the height of a full receptacle fill level of an 8–12 cup receptacle. The range is stated thusly to take into account the various pot capacities and configurations, some of which are larger at the bottom than the top.

While the top assembly and the receptacle wall above the coffee level inherently act as a condenser, it is possible to further reduce even that small vapor loss to atmosphere through the vent means by providing additional surface area on the top assembly, in essence a condenser section.

It is the concept of combining a pour spout and vented top assembly, which may or may not include a condenser section, as an integral, unit handled structure for a conventional coffee receptacle that is one important aspect of the invention.

If the top assembly is to be placed on a receptacle after it is filled with coffee then the vent means need involve only a single vent opening whereas if the top is to be placed on the decanter prior to its placement under a drip coffeemaker to receive freshly brewed coffee through a central "vent means", then a second vent opening must be provided to allow escape of displaced air as the pot is filled. Alternatively, the receptacle may be filled through a large central opening in the top assembly, as is conventional, with the same being subsequently closed by a slide valve or the like containing the restricted vent means. It is not the number or the spacing of the vent openings that is critical, rather it is their cumulative area; i.e. their cumulative area must be sufficiently small as to maintain superatmospheric pressure within the receptacle when it contains a quantity of hot coffee above 160° F. Indeed, specific holes need not be formed in the top assembly if the top assembly is so interfitted with the open top of the receptacle that vent air can be admitted while precluding the outflow of coffee as the receptacle is tilted to "pour from the bottom". Exemplary of the latter would be a screw cap substantially, but not totally, sealed with respect to atmosphere.

The fact of the superatmospheric maintenance within a glass receptacle is readily discernible when the pour spout is made of glass or a transparent plastic since the coffee level, within the pour spout, may be seen to fluctuate at levels at and above the level of the main body of contained coffee.

In summary, a quantity of hot coffee in a coffee receptacle having a small diameter pour spout extending upwardly from the bottom through the open top of the receptacle is substantially sealed with respect to atmosphere by a top assembly containing vent means of such cumulative dimension that the vapor pressure of the coffee exceeds atmospheric. Accordingly, except at that moment when coffee is being poured the quantity of coffee is sealed from atmosphere by a liquid seal within the pour spout and a vapor seal across the vent means thus substantially reducing oxidation. Evaporation is substantially eliminated as the partial pressures across the liquid/gas interface approach equilibrium in the substantially sealed receptacle. Although seemingly simple in retrospect, one of the greater advantages of the invention from the standpoint of consumer acceptance is that its objectives are achieved in a unit handled construction employing no moving parts and imposing no constraints on conventional methods of coffee service.

Coffee receptacles constructed in accordance with the present invention extend the normal pot life of a quantity of coffee from 400% to 600% depending on the initial quantity and rate of depletion by consumption.

DESCRIPTION OF THE PREFERRED EMBODIMENTS

Figure 2:
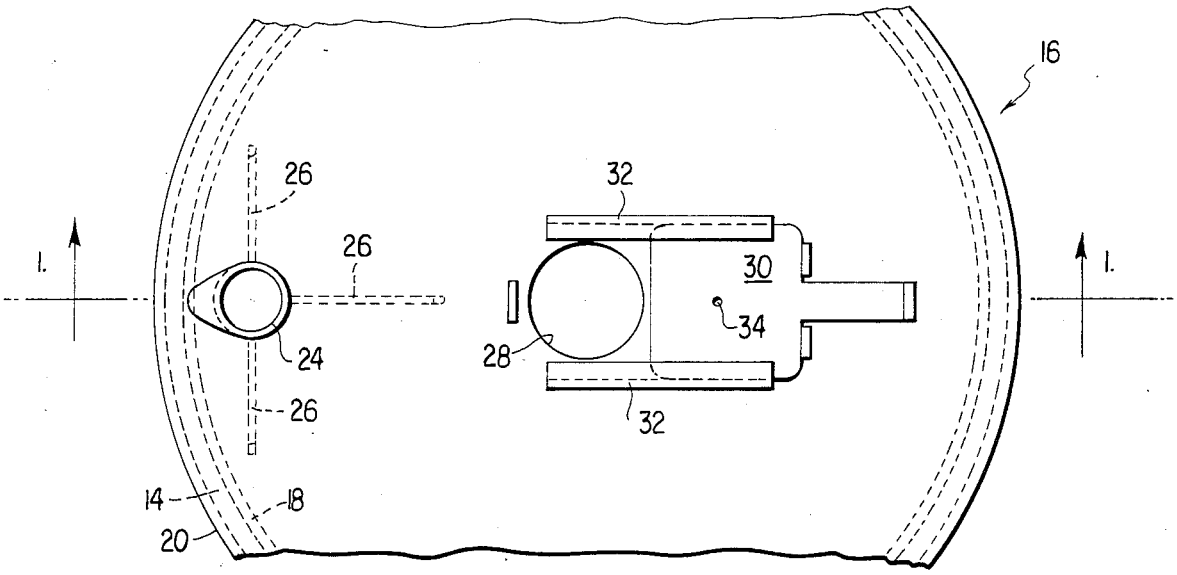
FIG. 2 is a fragmentary, top plan view of FIG. 1.
Figure 1:
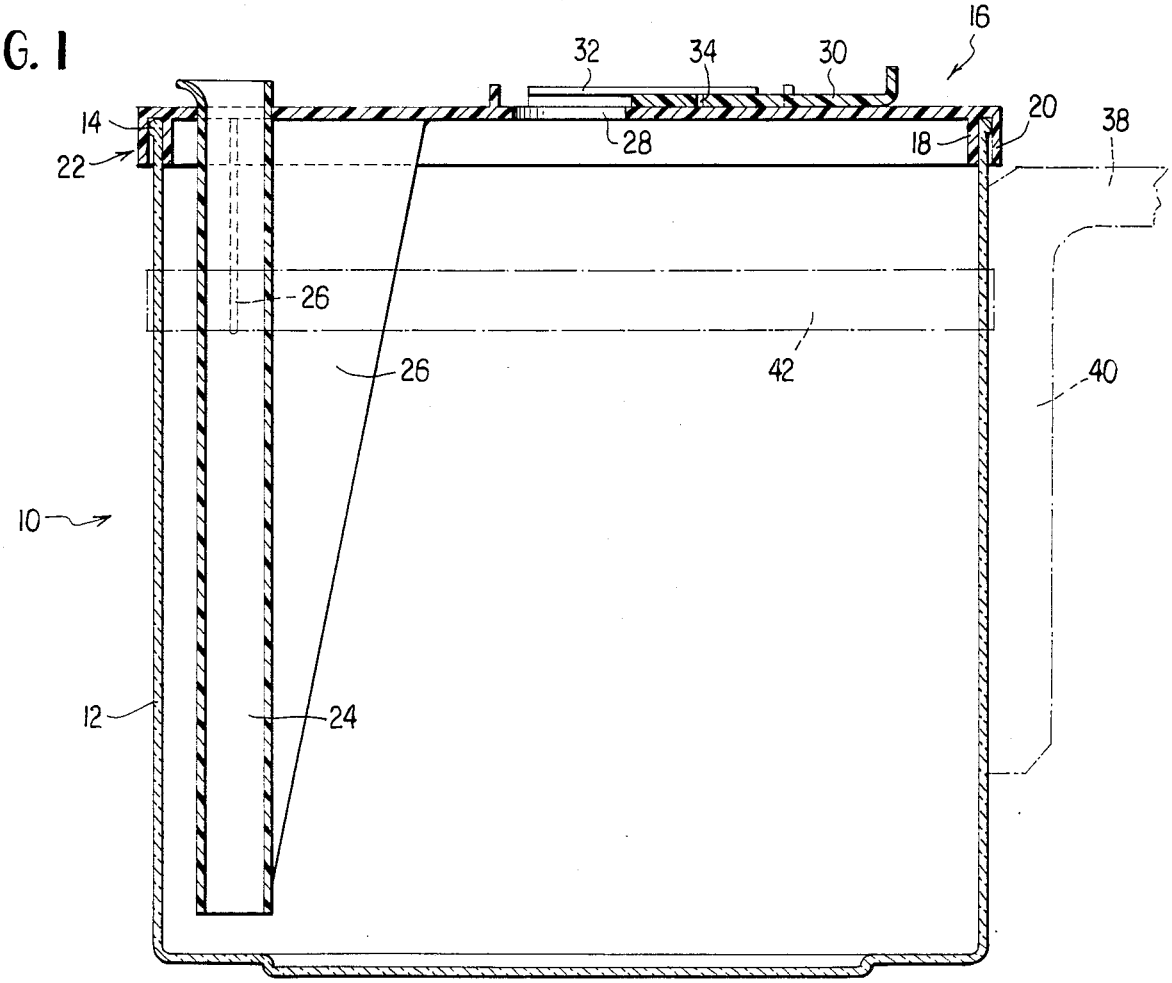
FIG. 1 is a vertical section, with parts shown in phantom, of a coffee receptacle incorporating the invention.

In FIGS. 1 and 2 is illustrated a coffee receptacle 10 having an imperforate peripheral wall 12 of glass or the like whose open, upper end terminates in a circular, beaded lip 14.

A plastic top assembly 16 includes spaced inner and outer circumferential flanges 18, 20 defining a downwardly directed locking ring 22 adapted to snap fit over beaded lip 14. An integrally formed pour spout 24 extends from adjacent the bottom of receptacle 10 to the upper surface of top assembly 16 and includes reinforcing ribs 26. A central fill opening 28 in top assembly 16 is adapted to be selectively closed by a slide valve 30 supported by guide brackets 32 integrally formed with the top assembly. Slide valve 30 is formed with a small vent opening 34 to permit dispensing of coffee through pour spout 24 when valve 30 is closed. Top assembly 16 is preferably formed by injection molding from a plastic such as polysufone or polycarbonate since the coffee temperature range with which the lower end of the pour spout will be in extended contact will vary from above 160° F. up to about 190° F. because the various warming burners with which the receptacle will be used vary significantly in their calibrations. The desired temperature range closely brackets 175° F. to produce a desired cup temperature of about 165° F.

Snap ring 22 may be interrupted if necessary to interfit with the upper end 38 of handle assembly 40 if it is formed to overlie a portion of the upper beaded lip 14 immediately adjacent the handle so long as the interfitting relationship is substantially tight. It will be recalled that it is immaterial whether such an interruption in snap ring 22 (not shown) makes a sealing fit on either side of the upper end 38 of the handle assembly since it is the cumulative vent area that is important. Thus if a perfect seal is not established on either side of the handle assembly, the unsealed portion is nevertheless very small so that its "vent" area taken with the vent area of central vent opening 34 still constitutes restricted "vent means" which will maintain superatmospheric pressure in the receptacle in the presence of a quantity of coffee maintained above 160° F. It is important that the seal on the pour side of the pot be intact so that coffee does not "leak" over the lip when dispensing through the pour spout.

The handle assembly 40 and the method of attachment of its steel band 42 are entirely conventional and play no contributing role to the present invention beyond the fact that some handle assembly is required.

In operation of the embodiment shown in FIGS. 1 and 2; top assembly 16 is interfitted with receptacle 10 and slide valve 30 is placed in the open position of FIG. 2. The receptacle is then placed beneath an automatic drip coffee maker and freshly brewed coffee flows through central fill opening 28. When the receptacle is filled, slide valve 30 is moved to the closed position. With a conventional warming burner maintaining coffee temperature at approximately 175° F. the coffee vapor above the coffee level finds its self in a substantially closed system by virtue of the liquid seal blocking pour spout 24 and the pin hole vent 34 allowing substantially less vapor loss to atmosphere than is built up by vaporization across the liquid/gas interface. The result is the production of a superatmospheric condition within the receptacle blocking air entry through the vent means and production of an approach to equilibrium across the liquid/gas interface substantially eliminating evaporative loss to atmosphere. The oxidizing effects of that relatively negligible volume of air indrawn through the vent means produces little deterioration by oxidation over a 4–6 hour period depending upon the rate of depletion by consumption.

Instead of employing a central fill opening and slide valve; the upper surface of top assembly 16 may be imperforate except for a vent opening. In such event the top assembly would be applied after the decanter is filled.

Figure 3:
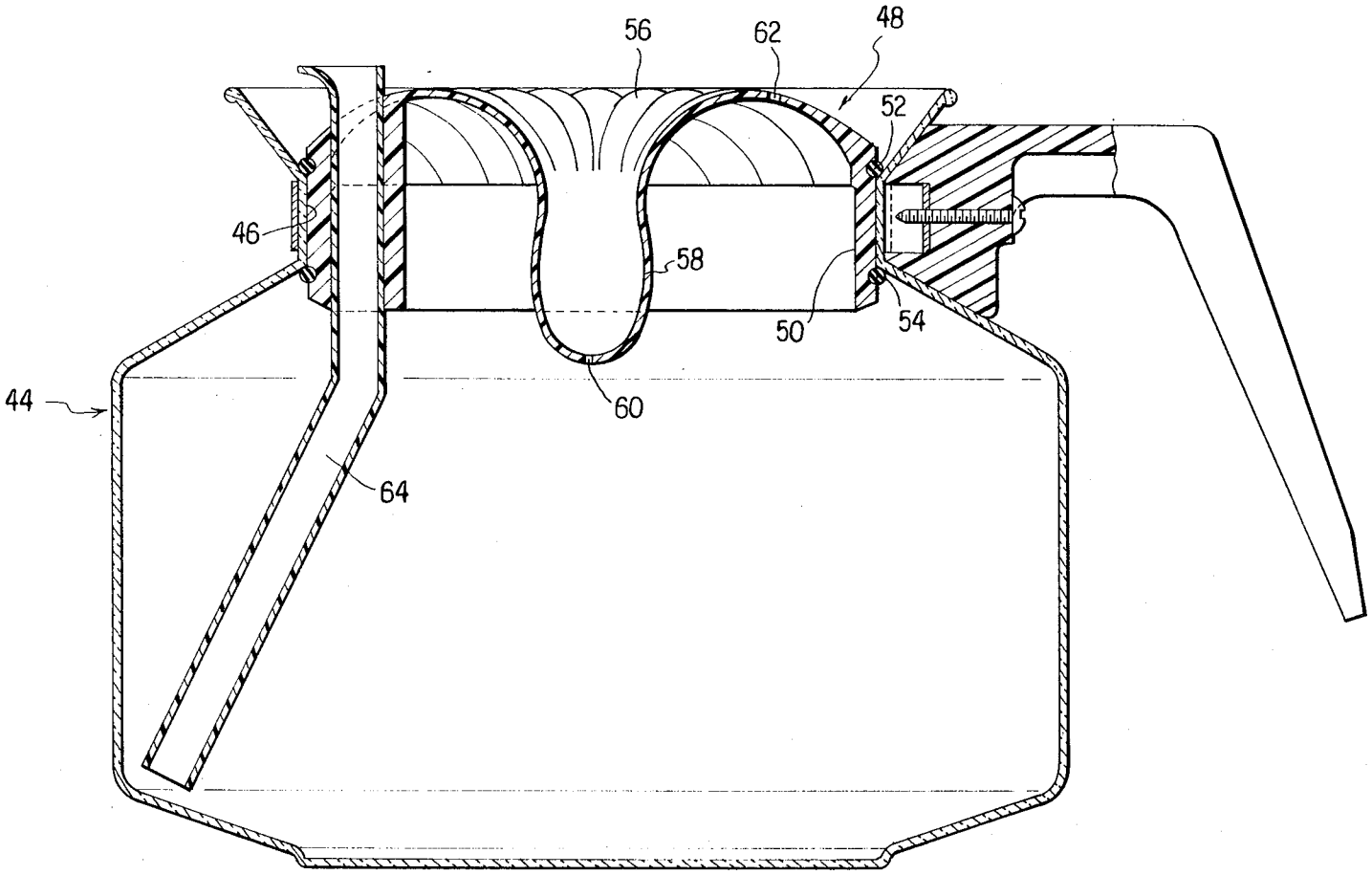
FIG. 3 is a vertical section, with parts in elevation, of a modified form of the invention.
Figure 4:
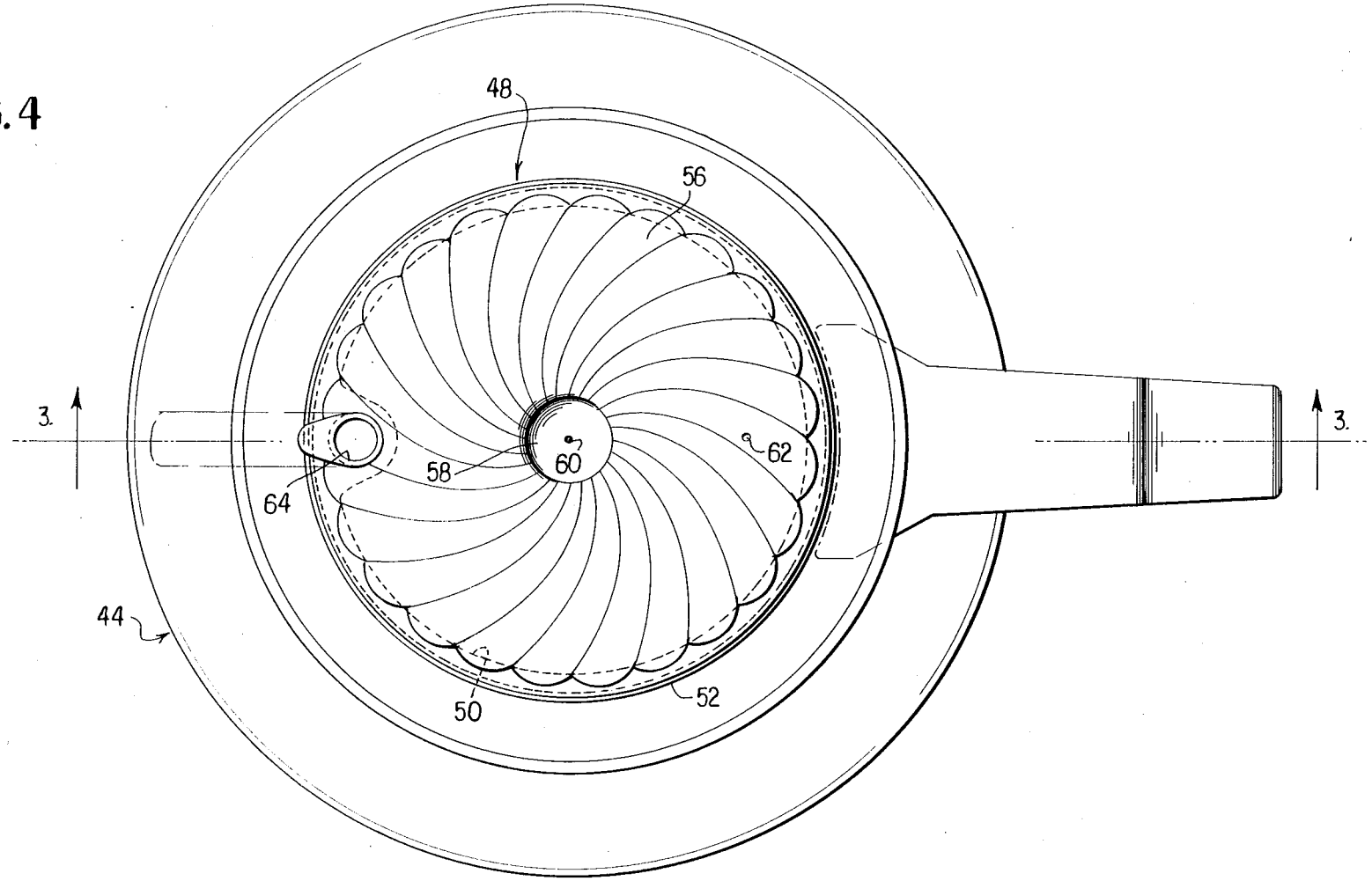
FIG. 4 is a top plan view of FIG. 3.

The embodiment shown in FIGS. 3 and 4 illustrate an application of the invention to a different style coffee decanter and employs a top assembly of increased surface area and wherein the vent means also functions as a fill opening.

In FIG. 3 is illustrated a glass coffee receptacle 44 whose open, upper end includes a cylindrical neck opening 46.

A top assembly 48, formed from a deformable material such as plastic or thelike, includes a cylindrical skirt 50 sized to fit neck opening 46 and is sealed with respect thereto by deformable ring seals 52, 54 respectively engaging the upper and lower edges of the cylindrical neck opening. The top assembly includes a convoluted condenser section 56 merging centrally with a well 58 whose lowermost portion is formed with a combined drip and vent opening 60. An additional vent opening 62 is formed at a location outside the well on a side remote from the pour side of the decanter. A small diameter pour spout 64 extends from adjacent the bottom of receptacle 44 to the upper surface of top assembly 48. Pour spout 64 may have an I.D. of ⅜" and is formed integrally with top assembly 48, as by blow molding or the like, or it may be separately formed and secured to the top assembly by a secondary operation. In either event, top assembly 48 which includes the condenser section 56 and pour spout 64 is a unit handled assembly which can be applied to the neck opening 46 as readily as a conventional top can be applied.

When used with an automatic drip coffee maker, top assembly 48 may be placed on the receptacle before the coffee is brewed. The freshly brewed coffee then flows into well 58 and through drip opening 60 into the receptacle. Vent hole 62 allows escape of displaced air as the receptacle is filled past the lower open end of pour spout 64.

The cumulative area of vent openings 60 and 62 are chosen to be sufficiently small as to maintain superatmospheric pressure in the receptacle when the quantity of coffee adapted to be contained therein is kept at, at least 160° F. With the usual coffee maintenance temperature of 175° F., the vent opening 60may be 1/16" in diameter and vent opening 62, 1/64" in diameter. Where the coffee is not to be introduced to the receptacle through well opening 61, it is desirable that the same be even smaller to further reduce vapor escape to atmosphere.

What is claimed is:

1. For use in association with a coffee decanter of the type primarily intended for use with automatic coffee makers, and which comprise a substantially symmetrical imperforate container having an open top mouth, a top assembly for removable attachment to the coffee decanter and configured to inhibit oxidation and evaporation of coffee as contained within the coffee decanter, said top assembly including a body portion defining a cover for the open mouth of the coffee decanter and having an outlying portion engageable in substantially sealing relationship with the contour of the open mouth of the coffee decanter for removable attachment of said top assembly to the coffee decanter as a cover for the open mouth thereof, and an elongated pour spout extend within the coffee decanter from said body portion to adjacent the bottom of the coffee decanter, the upper end of said pour spout opening outwardly of said top assembly for pouring of coffee therefrom, and the lower end of said pour spout opening immediately adjacent the bottom and immediately adjacent the pouring side of the coffee decanter for egress of coffee thereinto from adjacent the bottom of the coffee decanter, said body portion including normally open vent means, the cumulative area of said vent means being such that the vapor pressure of heated coffee in the container exceeds atmospheric pressure to substantially create a vapor seal across said vent means.

2. A top assembly as specified in claim 1 and wherein said top assembly includes a substantially centrally disposed orifice for ingress of coffee therethrough and into the coffee decanter.

3. A top assembly as specified in claim 2 and wherein said top assembly includes valve means for closure of said orifice and said valve means includes said vent means.

4. A top assembly as specified in claim 1 and wherein said top assembly is substantially wholly contained within the profile of the coffee decanter.

5. A top assembly as specified in claim 1 and wherein said top assembly includes a condenser section.

6. A top assembly as specified in claim 1 and wherein said top assembly is configured so that the upper surface thereof defines a substantially centrally disposed well for receiving coffee, a vent means being provided adjacent the lowermost reach of said well for ingress of coffee therethrough and into the coffee decanter.

7. A top assembly as specified in claim 6 and wherein said top assembly includes a second vent means disposed peripherally of said well.

8. A top assembly as specified in claim 6 and wherein said top assembly is convoluted to provide said well and a condenser section.

9. A top assembly as specified in claim 7 and wherein said top assembly is convoluted to provide said well and a condenser section.

10. A top assembly as specified in claim 1 and wherein said outlying portion of said top assembly includes a locking ring adapted to snap fit about the mouth of the coffee decanter.

11. A top assembly as specified in claim 1 and wherein said outlying portion of said top assembly comprises a skirt portion sized to interfit within the mouth of the coffee decanter and including deformable ring seal means disposed for sealing engagement with the mouth thereof.

12. A top assembly as specified in claim 2 and wherein said outlying portion of said top assembly includes a locking ring adapted to snap fit about the mouth of the coffee decanter.

13. A top assembly as specified in claim 2 and wherein said outlying portion of said top assembly comprises a skirt portion sized to interfit within the mouth of the coffee decanter and including deformable ring seal means disposed for sealing engagement with the mouth thereof.

14. A top assembly as specified in claim 3 and wherein said outlying portion of said top assembly includes a locking ring adapted to snap fit about the mouth of the coffee decanter.

15. A top assembly as specified in claim 3 and wherein said outlying portion of said top assembly comprises a skirt portion sized to interfit within the mouth of the coffee decanter and including deformable ring seal means disposed for sealing engagement with the mouth thereof.

16. A top assembly as specified in claim 4 and wherein said outlying portion of said top assembly includes a locking ring adapted to snap fit about the mouth of the coffee decanter.

17. A top assembly as specified in claim 4 and wherein said outlying portion of said top assembly comprises a skirt portion sized to interfit within the mouth of the coffee decanter and including deformable ring seal means disposed for sealing engagement with the mouth thereof.

18. A top assembly as specified in claim 5 and wherein said outlying portion of said top assembly includes a locking ring adapted to snap fit about the mouth of the coffee decanter.

19. A top assembly as specified in claim 5 and wherein said outlying portion of said top assembly comprises a skirt portion sized to interfit within the mouth of the coffee decanter and including deformable ring seal means disposed for sealing engagement with the mouth thereof.

20. A top assembly as specified in claim 5 and wherein said outlying portion of said top assembly includes a locking ring adapted to snap fit about the mouth of the coffee decanter.

21. A top assembly as specified in claim 5 and wherein said outlying portion of said top assembly comprises a skirt portion sized to interfit within the mouth of the coffee decanter and including deformable ring seal means disposed for sealing engagement with the mouth thereof.

22. A top assembly as specified in claim 7 and wherein said outlying portion of said top assembly includes a locking ring adapted to snap fit about the mouth of the coffee decanter.

23. A top assembly as specified in claim 7 and wherein said outlying portion of said top assembly comprises a skirt portion sized to interfit within the mouth of the coffee decanter and including deformable ring seal means disposed for sealing engagement with the mouth thereof.

24. A top assembly as specified in claim 8 and wherein said outlying portion of said top assembly includes a locking ring adapted to snap fit about the mouth of the coffee decanter.

25. A top assembly as specified in claim 8 and wherein said outlying portion of said top assembly comprises a skirt portion sized to interfit within the mouth of the coffee decanter and including deformable ring seal means disposed for sealing engagement with the mouth thereof.

26. A top assembly as specified in claim 9 and wherein said outlying portion of said top assembly includes a locking ring adapted to snap fit about the mouth of the coffee decanter.

27. A top assembly as specified in claim 9 and wherein said outlying portion of said top assembly comprises a skirt portion sized to interfit within the mouth of the coffee decanter and including deformable ring seal means disposed for sealing engagement with the mouth thereof.

28. A top assembly as specified in claim 1 and wherein the opening of said pour spout adjacent the bottom of the container is positioned to open thereinto at below the substantially lower fourth to substantially lower sixth of the coffee decanter.

* * * * *